US006484610B1

(12) United States Patent
Macor

(10) Patent No.: US 6,484,610 B1
(45) Date of Patent: Nov. 26, 2002

(54) ACCESSIBLE ADJUSTABLE WRENCH

(75) Inventor: Richard J. Macor, Hunterdon County, NJ (US)

(73) Assignee: Proprietary Technologies, Inc., Asbury, NJ (US)

( * ) Notice: Subject to any disclaimer, the term of this patent is extended or adjusted under 35 U.S.C. 154(b) by 0 days.

(21) Appl. No.: 10/141,212

(22) Filed: May 8, 2002

(51) Int. Cl.[7] ..... B25B 13/16
(52) U.S. Cl. ..... 81/165; 81/186; 81/490
(58) Field of Search ..... 81/165, 186, 490, 81/170, 166, 167; D8/22

(56) References Cited

U.S. PATENT DOCUMENTS

| | | | | | |
|---|---|---|---|---|---|
| 572,035 | A | * | 11/1896 | Strokes | 81/165 |
| 588,110 | A | * | 8/1897 | Hoeft | 81/165 |
| 1,522,804 | A | * | 1/1925 | Carlson | 81/165 |
| 1,557,864 | A | * | 10/1925 | Mull | 81/165 |
| D178,773 | S | * | 9/1956 | Fercana | D8/22 |
| 2,808,751 | A | * | 10/1957 | Fercana | 81/165 |
| D261,096 | S | * | 10/1981 | Petersen | D8/22 |
| D326,037 | S | * | 5/1992 | Murayama | D8/22 |
| D414,996 | S | * | 10/1999 | Macor | D8/22 |

* cited by examiner

*Primary Examiner*—Lee Wilson

(57) ABSTRACT

An adjustable, open end wrench is described which has a wrench head for turning a variety of different size fasteners. The wrench head comprises two jaws each having an engaging surface for engaging with the fasteners. One jaw is generally fixed and connected to a gripping portion formed as a wrench lever and the other jaw is movable relative to the fixed jaw. The wrench head comprises an adjustable mechanism by which the jaws may be spaced apart including a maximum spacing dimension between the jaws. The wrench head further comprises an imaginary centerline intersecting both of the jaws substantially perpendicular to the engaging surfaces of the jaws as viewed from a side view thereof. And further wherein, each jaw has a width dimension measured at the centerline, and the width dimension of both jaws combined is relative to the maximum spacing dimension between the jaws. The width dimension of both jaws combined is substantially equal to or less than 85% of the maximum spacing dimension between the jaws, and, the width dimension of both jaws combined is substantially equal to or greater than 50% of the maximum spacing dimension between the jaws, so as to enhance the interaction and accessibility of the wrench to the fasteners.

27 Claims, 2 Drawing Sheets

ACCESSIBLE ADJUSTABLE WRENCH

REFERENCES TO RELATED APPLICATIONS

This application relates to other U.S. Patents granted to the inventor herein including U.S. Pat. No. Des. 414,996 entitled ADJUSTABLE WRENCH HEAD WITH BEAK TIP filed on Oct. 13, 1998; and, U.S. Pat. No. Des. 434,956 entitled ADJUSTABLE OPEN END WRENCH HEAD filed on Mar. 1, 1999. In addition, this application relates to U.S. patent application Ser. No. 091325,786 entitled ADJUSTABLE OPEN END WRENCH filed on Jun. 4, 1999 also by the inventor herein, and now abandoned.

FIELD OF THE INVENTION

The present invention relates to hand tools, particularly wrenches and most particularly adjustable, open end type wrenches.

BACKGROUND OF THE INVENTION

Adjustable, open end type wrenches have existed for many years. The American Society of Mechanical Engineers (ASME) has even developed standards for this common wrench. The advantages of an adjustable wrench are obvious. An adjustable wrench can vary the spacing between the jaws so that the one tool may interact with and turn a variety of different size fasteners. The disadvantages of an adjustable wrench are not immediately obvious. A major disadvantage of the typical, prior art adjustable wrench is its relatively wide structured head and jaws. The wide wrench head and wide jaws prohibit engagement and access with fasteners in limited access environments. Accordingly, there is a need to develop a better adjustable, open end wrench, structured differently than the prior art adjustable wrenches, to improve engagement and access with fasteners located in limited access environments.

SUMMARY OF THE INVENTION

An adjustable, open end wrench is described which has a wrench head for turning a variety of different size fasteners. The wrench head comprises two jaws each having an engaging surface for engaging with the fasteners. One jaw is generally fixed and connected to a gripping portion formed as a wrench lever and the other jaw is movable relative to the fixed jaw. The wrench head comprises an adjustable means by which the jaws may be spaced apart including a maximum spacing dimension between the jaws. The wrench head further comprises an imaginary centerline intersecting both of the jaws substantially perpendicular to the engaging surfaces of the jaws, as viewed from a side view thereof. And further wherein, each jaw has a width dimension measured at the centerline, and the width dimension of both jaws combined is relative to the maximum spacing dimension between the jaws. The width dimension of both jaws combined is generally equal to or less than 85% of the maximum spacing dimension between the jaws, and, the width dimension of both jaws combined is generally equal to or greater than 50% of the maximum spacing dimension between the jaws, so as to enhance the engagement and accessibility of the wrench to the fasteners.

As defined earlier herein, a major disadvantage of the prior art adjustable wrench is its relatively wide structured head and jaws. The wide wrench head and wide jaws prohibit engagement and access with fasteners located in limited access environments. Accordingly, there is a need to develop a better adjustable wrench which is structured differently than the prior art adjustable wrenches, to improve engagement and access with fasteners located in limited access environments.

Accordingly, it is an important objective of the present invention described above to achieve an improved adjustable wrench which can engage with and access fasteners located in limited access environments.

It is another objective of the present invention that it be durable and strong enough to exceed the standards developed by the American Society of Mechanical Engineers (ASME).

It is another objective of the present invention that it be commercially viable, simple in design, and cost efficient to manufacture.

DETAILED DESCRIPTION OF THE DRAWINGS

Figure 1:
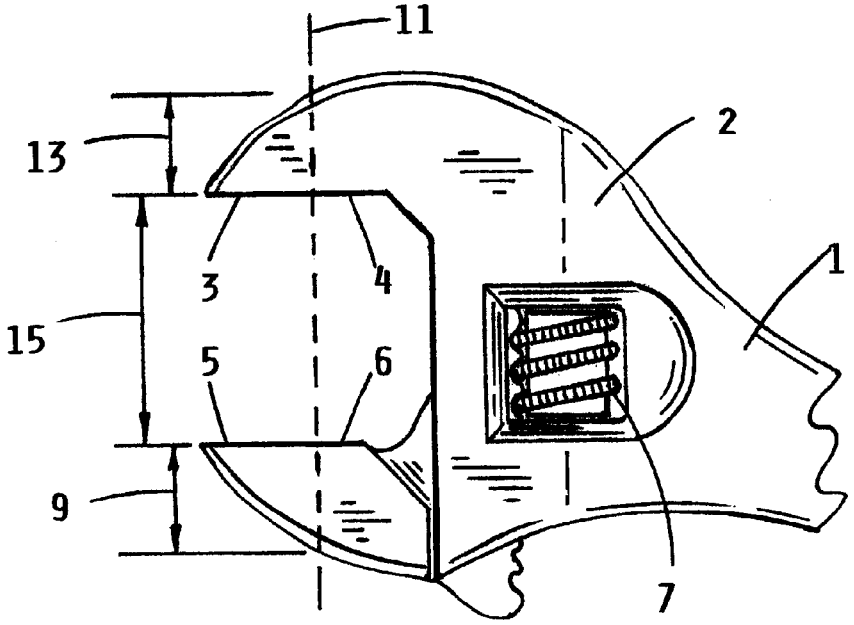
FIG. 1 PRIOR ART
FIG. 1 shows a left side, sectional view of a Prior Art adjustable wrench with details of the adjustable wrench head; and, FIG. 2 shows a left side, sectional view of a present invention adjustable wrench with details of the adjustable wrench head; and, FIG. 3 shows a left side, view of a present invention adjustable wrench in its entirety.

Referring now to the drawings which are for the purpose of illustrating preferred embodiments of the present invention and not for the purpose of limiting same, FIG. 1 shows a left side, sectional view of a Prior Art adjustable wrench with details of the adjustable wrench head. Adjustable wrench 1 has a wrench head 2 comprising a fixed jaw 3 and a movable jaw 5. Wrench head 2 is typical of a prior art adjustable wrench head in both shape and structure. Jaw 3 has engaging surface 4, and jaw 5 has engaging surface 6, both engaging surfaces formed for engagement with various fasteners, nuts bolts etc. Wrench head 2 includes an imaginary centerline 11 which is about centered relative to the length of jaws 3 and 5, and substantially perpendicular to engaging surfaces 4 and 6 as shown. Adjustable means 7 is used to space jaws 3 and 5 at different dimensions to engage with and turn various fasteners having various different dimensions. The maximum spacing dimension between the jaws is shown here by dimension 15, which is the maximum amount jaws 3 and 5 may be spaced apart using adjustable means 7. This maximum spacing dimension relates to other dimensions of the wrench head including the jaw width dimension 13 of jaw 3, and the jaw width dimension 9 of jaw 5. Both jaw width dimensions are measured at imaginary centerline 11 and substantially perpendicular to the jaw engaging surfaces 4 and 6 as shown. Many factors have contributed to the jaw width dimensions of the typical, prior art wrench shown, including strength and durability specifications developed by the American Society of Mechanical Engineers (ASME). Whereas, the jaw width dimension 13 of jaw 3, combined with the jaw width dimension 9 of jaw 5, is about equal to the maximum spacing dimension 15 as shown. In other words, if the maximum spacing dimension 15 of wrench head 2 was about 1.25 inches, the jaw width dimensions 13 and 9 (combined together) would also be equal to about 1.25 inches, or 100% of the maximum spacing dimension as defined herein. This dimensional relationship may vary slightly but is very typical of prior art adjustable, open end wrenches. The advantages of an adjustable wrench are obvious. An adjustable wrench can vary the spacing between the jaws so that the one tool may interact and turn a variety of different size fasteners. The disadvantages of an adjustable wrench are not immediately obvious. A major disadvantage of the typical, prior art adjustable wrench is its relatively wide structured head and jaws. The wide wrench head and wide jaws prohibit interaction and access with fasteners in limited access environments. Accordingly, there is a need to develop a better adjustable, open end wrench which is formed differently than the prior art adjustable wrenches, to improve engagement and access with fasteners located in limited access environments.

Figure 2:
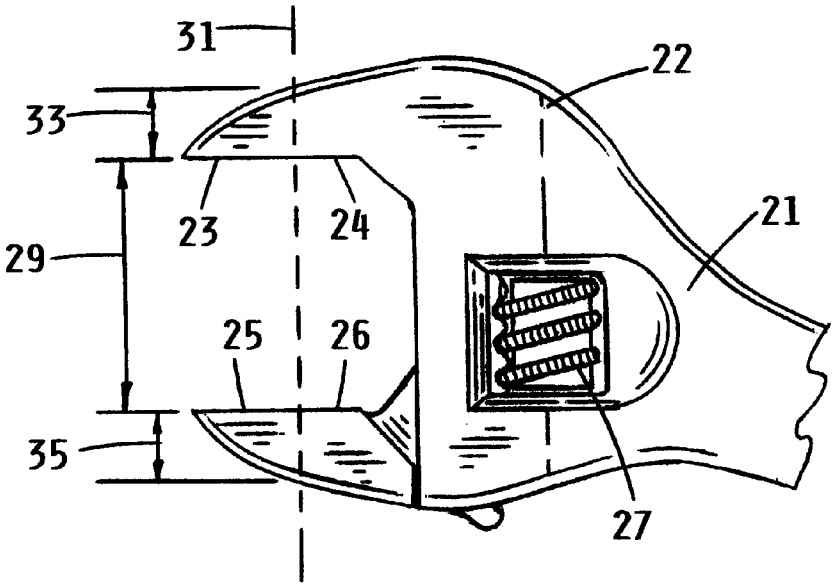

FIG. 2 shows a left side, sectional view of a present invention adjustable wrench with details of the adjustable wrench head. In this view, adjustable wrench 21 is shown having wrench head 22 for turning a variety of different size fasteners. Wrench head 22 comprises two jaws 23 and 25 each having an engaging surface for engaging with the fasteners. Jaw 23 has engaging surface 24, and, jaw 25 has engaging surface 26. These engaging surfaces may be planar and/or roughened to enhance the coefficient of friction between the engaging surface and fastener being turned. Jaw 23 is generally fixed and connected to a gripping portion formed as a wrench lever (not shown in this sectional view) and the other jaw 25 is movable relative to fixed jaw 23. Wrench head 22 also comprises an adjustable means 27 by which jaws 23 and 25 may be spaced apart including a maximum spacing dimension 29 between the jaws. Wrench head 22 further comprises an imaginary centerline 31 which is about centered relative to the length of jaws 23 and 25, and substantially perpendicular to engaging surfaces 24 and 26 as shown in this side view. Maximum spacing dimension 29 is the maximum amount jaws 23 and 25 may be spaced apart using adjustable means 27. This maximum spacing dimension relates to other dimensions of the wrench head including jaw width dimension 33 and jaw width dimension 35. The jaw width dimension of each jaw is measured at the centerline 31, and the width dimension of both jaws combined (33+35) is relative to the maximum spacing dimension 29 between the jaws. The width dimension of both jaws combined (33+35) is generally equal to or less than 85% of the maximum spacing dimension 29 between the jaws. And, the width dimension of both jaws combined (33+35) is generally equal to or greater than 50% of the maximum spacing dimension between the jaws. In other words, if the maximum spacing dimension 29 of wrench head 22 was about 1.25 inches, the jaw width dimensions 33 and 35 (combined together) would be equal to or less than 85% of 1.25 inches, and, equal to or greater than 50% of 1.25 inches. Preferred embodiments of the present invention, adjustable wrench head have jaws wherein the width dimension of both jaws combined (33+35) is generally equal to or less than 75% of the maximum spacing dimension 29 between the jaws. And, the width dimension of both jaws combined (33+35) is generally equal to or greater than 55% of the maximum spacing dimension between the jaws. Such a structural arrangement provides superior engagement and access with fasteners located in limited access environments.

Figure 3:
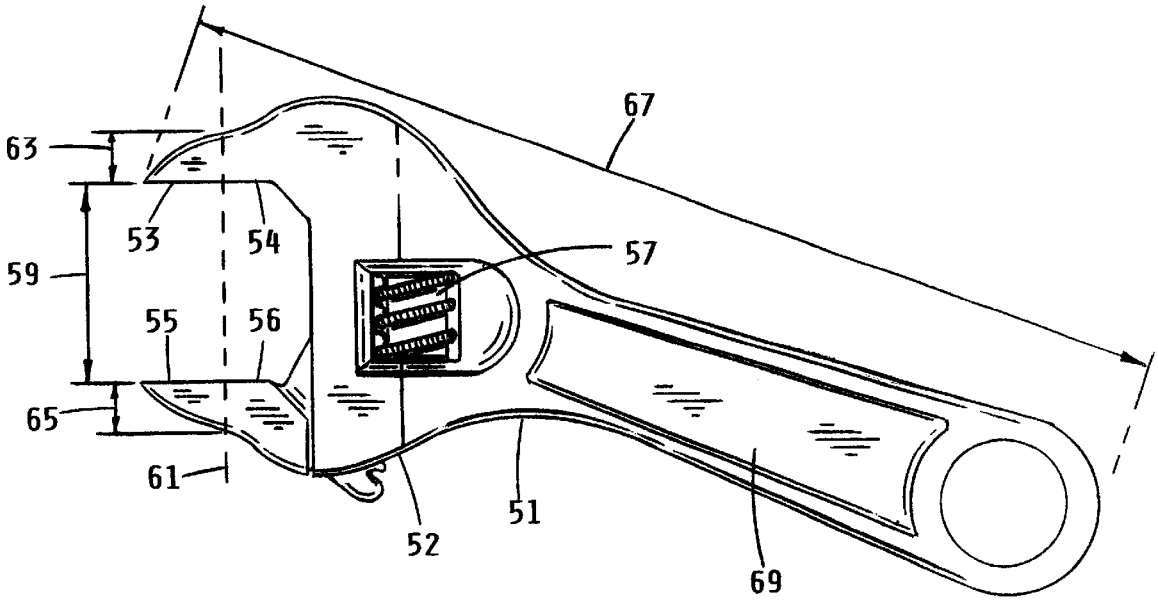

FIG. 3 shows a left side view of a present invention adjustable wrench in its entirety. In this view, adjustable wrench 51 is shown having wrench head 52 for turning a variety of different size fasteners. Wrench head 52 comprises two jaws 53 and 55 each having an engaging surface for engaging with the fasteners. Jaw 53 has engaging surface 54, and, jaw 55 has engaging surface 56. These engaging surfaces may be planar and/or roughened to enhance the coefficient of friction between the engaging surface and fastener being turned. Jaw 53 is generally fixed and connected to gripping portion 69 formed as a wrench lever, and jaw 55 is movable relative to fixed jaw 53. Wrench head 52 also comprises an adjustable means 57 by which jaws 53 and 55 may be spaced apart including a maximum spacing dimension 59 between the jaws. Wrench head 52 further comprises an imaginary centerline 61 which is about centered relative to the length of jaws 53 and 55, and substantially perpendicular to engaging surfaces 54 and 56 as shown in this side view. Maximum spacing dimension 59 is the maximum amount jaws 53 and 55 may be spaced apart using adjustable means 57. This maximum spacing dimension relates to other dimensions of the wrench head including jaw width dimension 63 and jaw width dimension 65. The jaw width dimension of each jaw is measured at the centerline 61, and the width dimension of both jaws combined (63+65) is relative to the maximum spacing dimension 59 between the jaws. In this preferred embodiment, the width dimension of both jaws combined (63+65) is generally equal to or less than 85% of the maximum spacing dimension 59 between the jaws. And, the width dimension of both jaws combined (63+65) is generally equal to or greater than 50% of the maximum spacing dimension between the jaws. In other words, if the maximum spacing dimension 59 of wrench head 52 was about 1.25 inches, the jaw width dimensions 63 and 65 (combined together) would be equal to or less than 85% of 1.25 inches, and also, equal to or greater than 50% of 1.25 inches. With regards to the more preferred embodiments of the present invention, the width dimension of both jaws combined (63+65) is generally equal to or less than 75% of the maximum spacing dimension 59 between the jaws. And, the width dimension of both jaws combined (63+65) is generally equal to or greater than 55% of the maximum spacing dimension between the jaws. Such a structural arrangement provides superior engagement and access to fasteners located in limited access environments. Another novel feature of adjustable wrench 51 is the relationship of its entire length 67 to the maximum spacing dimension 59. In some cases, preferred embodiments of the present invention may have a shortened handle or lever to provide sufficient torque strength to the jaws 63 and 65, defined by the American Society of Mechanical Engineers (ASME). Here the total length 67 of wrench 51 is about equal to or less than, seven times the maximum spacing dimension 59. In other words, if the maximum spacing dimension 59 was 1.25 inches, the total length 67 of wrench 51 would be equal to or less than (7×1.25 inches), or 8.75 inches. By providing for a shorter wrench (and shorter lever) the wrench can more easily achieve the specifications developed by the American Society of Mechanical Engineers (ASME), even if, the jaws are structured thinner as defined herein for superior engagement and access with fasteners located in limited access environments.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws, said wrench head further comprising an imaginary centerline intersecting both of said jaws substantially perpendicular to the engaging surfaces of said jaws and passing through a midpoint of a length of the jaws as viewed from a side view thereof, and further wherein, each said jaw has a width dimension measured at said centerline, and the width dimension of both jaws combined is relative to the maximum spacing dimension between said jaws, and, the width dimension of both said jaws combined is substantially equal to or less than 85% of the maximum spacing dimension between said jaws, and, the width dimension of both said jaws combined is substantially equal to or greater than 50% of the maximum spacing dimension between said jaws, so as to enhance the engagement and accessibility of said wrench to said fasteners.

2. The wrench head of claim 1, wherein the engaging surface of at least one jaw is substantially planar.

3. The wrench head of claim 1, wherein the engaging surface of at least one jaw is substantially roughened.

4. The wrench head of claim 1, wherein the engaging surfaces of both said jaws are each substantially planar.

5. The wrench head of claim 1, wherein the width dimension of both said jaws combined is substantially equal to or less than 75% of the maximum spacing dimension between said jaws, and, the width dimension of both said jaws combined is substantially equal to or greater than 55% of the maximum spacing dimension between said jaws, so as to enhance the engagement and accessibility of said wrench to said fasteners.

6. The wrench head of claim 1, wherein the engaging surfaces of both said jaws are each substanially roughened.

7. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws, said wrench head further comprising an imaginary centerline intersecting both of said jaws substantially perpendicular to the engaging surfaces of said jaws and passing through a midpoint of a length of the jaws as viewed from a side view thereof, and further wherein, each said jaw has a width dimension measured at said centerline, and the width dimension of both said jaws combined is relative to the maximum spacing dimension between said jaws, and, the width dimension of both said jaws combined is substantially equal to or less than 75% of the maximum spacing dimension between said jaws, and, the width dimension of both said jaws combined is substantially equal to or greater than 55% of the maximum spacing dimension between said jaws, so as to enhance the engagement and accessibility of said wrench to said fasteners.

8. The wrench head of claim 7, wherein the engaging surface of at least one jaw is substantially planar.

9. The wrench head of claim 7, wherein the engaging surface of at least one jaw is substantially roughened.

10. The wrench head of claim 7, wherein the engaging surfaces of both said jaws are each substantially planar.

11. The wrench head of claim 7, wherein the engaging surfaces of both said jaws are each substantially roughened.

12. The wrench of claim 7, wherein said adjustable wrench has a total length, and the total length of said wrench is substantially equal to or less than, seven times the maximum spacing dimension between said jaws.

13. The wrench head of claim 12, wherein the engaging surface of at least one jaw is substantially planar.

14. The wrench head of claim 12, wherein the engaging surface of at least one jaw is substantially roughened.

15. The wrench head of claim 12, wherein the engaging surfaces of both said jaws are each substantially planar.

16. The wrench head of claim 12, wherein the engaging surfaces of both said jaws are each substantially roughened.

17. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws, said wrench head further comprising an imaginary centerline intersecting both of said jaws substantially perpendicular to the engaging surfaces of said jaws and passing through a midpoint of a length of the jaws as viewed from a side view thereof, and further wherein, each said jaw has a width dimension measured at said centerline, and the width dimension of both said jaws combined is relative to the maximum spacing dimension between said jaws, and, the width dimension of both said jaws combined is substantially equal to or less than 75% of the maximum spacing dimension between said jaws, and, the width dimension of both said jaws combined is substantially equal to or greater than 55% of the maximum spacing dimension between said jaws, and further wherein, said wrench has a total length, and the total length of said wrench is substantially equal to or less than, seven times the maximum spacing dimension between said jaws, so as to enhance the engagement and accessibility of said wrench to said fasteners.

18. The wrench head of claim 17, wherein the engaging surface of at least one jaw is substantially planar.

19. The wrench head of claim 17, wherein the engaging surface of at least one jaw is substantially roughened.

20. The wrench head of claim 17, wherein the engaging surfaces of both said jaws are each substantially planar.

21. The wrench head of claim 17, wherein the engaging surfaces of both said jaws are each substantially roughened.

22. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws, said wrench head further comprising an imaginary centerline intersecting both of said jaws substantially perpendicular to the engaging surfaces of said jaws and passing through a midpoint of a length of the jaws as viewed from a side view thereof, and further wherein, each said jaw has a width dimension measured at said centerline, and the width dimension of both jaws combined is relative to the maximum spacing dimension between said jaws, and, the width dimension of both said jaws combined is substantially equal to or less than 70% of the maximum spacing dimension between said jaws, and, the width dimension of both said jaws combined is substantially equal to or greater than 50% of the maximum spacing dimension between said jaws, so as to enhance the engagement and accessibility of said wrench to said fasteners.

23. The wrench head of claim 22, wherein said adjustable wrench has a total length, and the total length of said wrench is substantially equal to or less than, six times the maximum spacing dimension between said jaws.

24. The wrench head of claim 22, wherein the engaging surfaces of both said jaws are each substantially planar.

25. The wrench head of claim 22, wherein the engaging surfaces of both said jaws are each substantially roughened.

26. The wrench head of claim 23, wherein the engaging surfaces of both said jaws are each substantially planar.

27. The wrench head of claim 23, wherein the engaging surfaces of both said jaws are each substantially roughened.

* * * * *